United States Patent [19]

Schoeps

[11] Patent Number: 4,735,595

[45] **Date of Patent: * Apr. 5, 1988**

[54] HYDRAULIC TORQUE IMPULSE TOOL

[75] Inventor: Knut C. Schoeps, Tyresö, Sweden

[73] Assignee: Atlas Copco Aktiebolag, Nacka, Sweden

[ * ] Notice: The portion of the term of this patent subsequent to Aug. 6, 2002 has been disclaimed.

[21] Appl. No.: 809,960

[22] Filed: Dec. 17, 1985

[30] Foreign Application Priority Data

Dec. 21, 1984 [SE] Sweden ..... 8406560

[51] Int. Cl.[4] ..... B25D 15/02

[52] U.S. Cl. ..... 464/25; 173/93

[58] Field of Search ..... 173/93, 93.5, 93.6; 464/24, 25

[56] References Cited

U.S. PATENT DOCUMENTS

| | | | |
|---|---|---|---|
| 3,116,617 | 1/1964 | Skoog | 464/25 |
| 3,203,203 | 8/1965 | Ward | 464/25 |
| 3,214,940 | 11/1965 | Kramer | 464/25 |
| 3,283,537 | 11/1966 | Gillis | 464/25 |
| 3,292,391 | 12/1966 | Kramer et al. | 173/93 X |
| 3,321,043 | 5/1967 | Vaughn | 173/93.5 X |
| 3,661,217 | 5/1972 | Maurer | 173/93.5 |
| 4,321,973 | 3/1982 | Maurer | 173/93.5 |
| 4,533,337 | 8/1985 | Schoeps | 464/25 |

FOREIGN PATENT DOCUMENTS 432071 3/1984 Sweden .

*Primary Examiner*—Daniel P. Stodola

*Attorney, Agent, or Firm*—Frishauf, Holtz, Goodman & Woodward

[57] ABSTRACT

A hydraulic torque impulse tool, comprising an inertia drive member (10;110) which is rotated by a motor and which includes a fluid chamber (19;119), and a seal and torque transmitting mechanism (30;130) which is arranged to divide the fluid chamber (19;119) into two compartments (38, 39; 138, 139) during a short interval of the relative rotation between the drive member (10;110) and the output spindle (11;111). A leaf spring valve (72; 171, 172) is arranged to control the flow through a bypass passage (70;170) interconnecting the two fluid chamber compartments (38, 39; 138, 139). The leaf spring valve (72;171, 172) which by its shape is pretensioned toward open condition automatically occupies the open condition as the difference in pressure between the fluid chamber compartments is low and a closed condition as this difference exceeds a certain level.

5 Claims, 2 Drawing Sheets

HYDRAULIC TORQUE IMPULSE TOOL

This invention relates to a hydraulic torque impulse tool, primarily intended for tightening and loosening threaded joints such as screws, bolts, nuts etc.

In particular, the invention concerns a hydraulic torque impulse tool comprising a tool housing, an inertia drive member coupled to a rotation motor in said housing and including a fluid chamber, an output spindle having an impulse receiving rear portion extending into said fluid chamber, an impulse generating seal means movably arranged in said fluid chamber and dividing the latter into at least one high pressure compartment and at least one low pressure compartment during one or more limited portions of its movement relative to said fluid chamber, a fluid passage means extending past said seal means, and a pressure responsive valve means arranged to control the flow through said passage means by shifting automatically from an open condition to a closed condition as the difference in pressure between said at least one high pressure compartment and said at least one low pressure compartment exceeds a certain level.

A hydraulic torque impulse tool of this type is previously described in U.S. Pat. No. 3,283,537. In this prior art tool the impulse generating seal means comprises a vane which is slidably supported in a radial slot in the rear portion of the output spindle and two diametrically opposite lands in the fluid chamber for simultaneous cooperation with the vane and the spindle itself, such that once each revolution of the relative rotation between the inertia drive member and the output spindle, the fluid chamber is divided into a high pressure compartment and a low pressure compartment.

Past this seal means there is a fluid passage and a spring biased valve. In this patent there are shown two alternative fluid passage locations, one in the inertia drive member (FIGS. 2 and 5) and another in the output spindle (FIG. 6). In both cases the fluid passage and valve are arranged to permit a bypass flow between the two fluid chamber compartments as the pressure difference between these compartments is below a certain level and to prevent such flow as the pressure difference exceeds that level. This means that the valve is shut at a high relative rotation speed between the drive member and the output spindle such that a high pressure impulse may be accomplished. It also means that at low relative rotation speed between the drive member and the output spindle the valve is kept open.

The purpose of this valve controlled bypass is to avoid a pressure build-up at low relative rotation speed. This occurs after delivery of each high pressure torque impulse when the drive member is abruptly stopped while the seal means is still effective in preventing fluid flow between the fluid chamber compartments. Without the provision of the valve controlled bypass passage, the acceleration of the drive member on the next impulse generating cycle would not commence until the engagement interval of the seal means had been passed and the hydraulic braking of the drive member had ceased. Such pressure build-up at low speed relative rotation between the drive member and the output spindle is undesirable since it extends the cycle time and, thereby, keeps down the impulse rate and output torque capacity of the tool.

The type of valve disclosed in the above patent, however, is disadvantageous in that it has a small flow capacity in relation to its dimensions and includes a helical bias spring which in this application has a limited service life due to its insufficient fatigue strength. The reason is that the high impulse generating pressure peaks are built up almost instantaneously and make the valve accelerate very rapidly. Accordingly the dynamic stresses to which the spring is exposed are severe.

The main object of the present invention is to accomplish a hydraulic torque impulse tool of the above type including an improved bypass control valve which has a large flow capacity and which is apt to withstand the dynamic stresses caused by the high impulse generating pressure peaks in the fluid chamber.

Further advantages and significant features of the invention will be apparent from the following description and drawings. In the drawings FIG. 1 shows a longitudinal section through a pivoting piston type torque impulse tool provided with a bypass controlling valve according to the invention.

Figure 1:
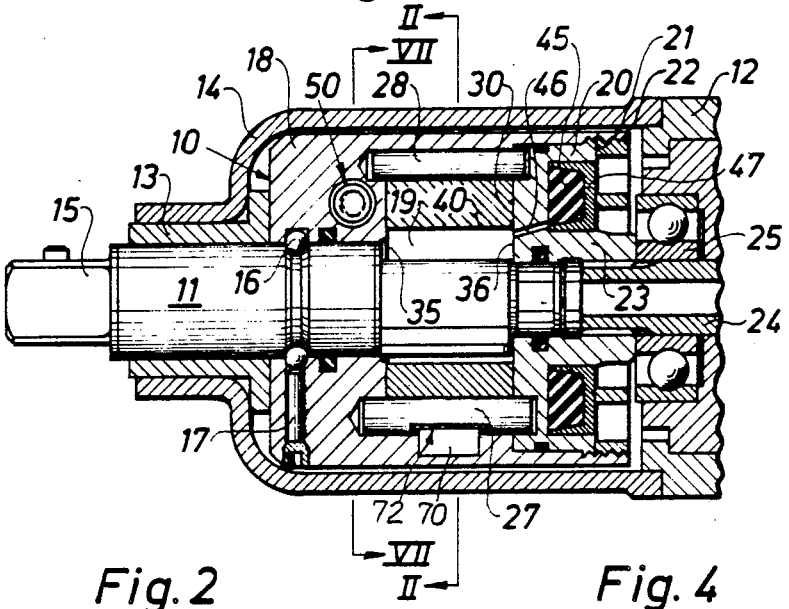

A complete torque impulse delivering tool consists not only of the hydraulic impulse mechanism, embodiments of which are illustrated in the drawing figures, but comprises a tool housing, tool support means, a rotation motor and power supply means. Since these details do not form any part of the invention and are not intimately related to the specific features of the impulse mechanism, the drawings have been limited to the impulse mechanism only.

The hydraulic impulse mechanism shown in FIGS. 1 to 5 comprises an inertia drive member 10 which is rotatably supported on an output spindle 11 which in turn is rotatably journalled in the tool housing 12. A bearing sleeve 13 mounted in the forward end portion 14 of the tool housing 12 forms the output spindle bearing. At its forward end, the output spindle 11 is formed with a square drive portion 15 on which a nut or screw engaging socket is attachable.

The inertia drive member 10 is axially locked relative to the output spindle 11 by means of steel balls 16 running in circumferential grooves in the spindle 11 and the inertia drive member 10. The balls 16 are inserted through a radial passage and are prevented from falling out that same way by a plug 17.

The inertia drive member 10 is mainly cylindrical in shape and comprises a cup-shaped main body 18 enclosing a concentric hydraulic fluid chamber 19. At its rear end, the fluid chamber 19 is closed by a separate end closure 20 which is locked in position by a ring nut 21 engaging internal threads 22 on the main body 18.

The end wall 20 is formed with a splined socket portion 23 in which the splined shaft 24 of the rotation motor (not shown) of the tool is received. One of the motor shaft bearings 25 serves as a bearing for the inertia member 10 as well.

Within the hydraulic fluid chamber 19, there are mounted two cylindrical pins 27, 28 which are parallel to each other as well as to the rotation axis of the inertia drive member 10. These pins 27, 28 are located diametrically opposite each other and are both partly received in longitudinal grooves in the chamber wall. (See Figs 2–5). Both pins 27, 28 also extend into the rear end closure 20, thereby positively locking the latter to the main body 18 as regards rotation.

One of the pins 27 serves as a fulcrum for a pivoting piston 30, whereas the other pin 28 forms a seal and guide means for cooperation with a seal portion 31 and two guide flanges 32, 33 on the piston 30. The piston 30 is formed with flat end surfaces 34, 35 for sealing cooperation with opposite flat end walls 35, 36 of the hydraulic fluid chamber 19. The chamber 19 is divided by the piston 30 into two compartments 38, 39.

The piston 30 is formed with a central opening 40 through which the rear end portion of the output spindle 11 extends. The edge contour of this opening 40 forms two sets of cam surfaces which are arranged to engage selectively two separate cam surfaces on the output spindle 11. There are provided two separate sets of cam surfaces on each one of the output spindle 11 and the piston 30- for the purpose of making the tool operative in both directions. However, only one set of cam means on each one of the output spindle 11 and the piston 30 is active to accomplish the intended engagement between the spindle 11 and the piston 30 when operating the tool in one direction.

For a normal clockwise rotation of the inertia drive member 10 relative to the output spindle 11 (see arrows in FIGS. 2–5), an abruptly inclined cam surface 42 on the output spindle 11 is engaged alternatingly by a likewise abruptly inclined cam surface 43 and a gradually sloping cam surface 44 on the piston 30. The cam surface inclinations are here related to the directions of thought circle tangents in each point of the cam profile.

By interengagement of the cam means on the output spindle 11 and the piston 30, the latter is caused to perform a reciprocative pivoting movement in the fluid chamber 19. A certain stroke length is thereby obtained.

Figure 2:
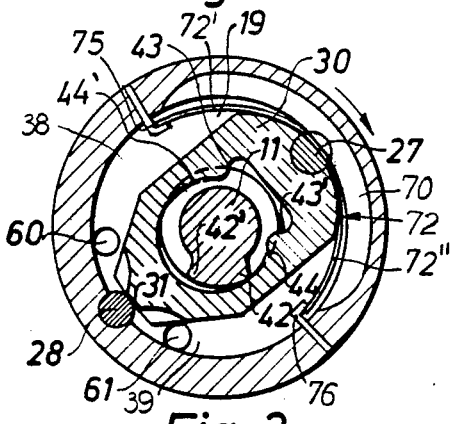
FIGS. 2 to 5 show cross sections taken along line II—II in FIG. 1, which illustrate different sequential positions of the torque impulse generating parts.

For accomplishing a pivoting movement of the piston 30 also when the inertia drive member 10 is rotated in the anti-clockwise direction, another abruptly inclined cam surface $42^1$ on the output spindle 11 is engaged alternatingly by an abruptly inclined cam surface $43^1$ and a gradually sloping cam surface $44^1$ on the piston 30. This is shown in FIG. 2 only. In the shown embodiments of the invention the cooperating cam means are symmetrically designed so as to generate the same piston operation characteristics in both directions of rotation.

For the purpose of absorbing changes in the hydraulic fluid volume due to temperature variations, an annular expansion chamber 45 is provided in the rear end closure 20. This expansion chamber 45 communicates with the fluid chamber 19 through a passage 46 and is filled with a foamed plastic material. The foamed plastic material is of the closed cell type and is acted upon directly by the hydraulic fluid. An annular end cover 47 secured in the end closure 20 by the ring nut 21 prevents the plastic material from falling out.

Figure 7:
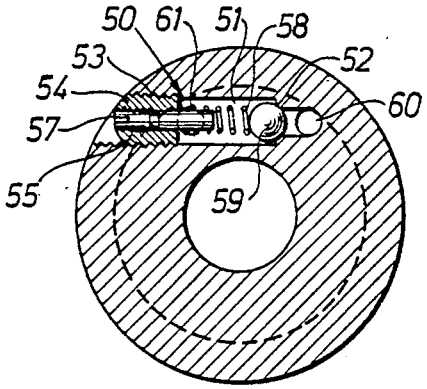
FIG. 7 shows a cross section taken along line VII—VII in FIG. 1.

In the inertia drive member 10 there is provided an output torque limiting device 50. See FIG. 7 in particular. This torque limiting device 50 comprises a bore 51 which is formed with a valve seat 52 at its inner end and having threads 53 at its outer end. Into the outer end of the bore 51 there is threaded a plug 54 which is formed with a threaded coaxial bore 55. A set screw 57 is received in the bore 55 and forms an axial support for a coil spring 58 loading a valve ball against the seat 52.

A passage 60 on one side of the valve 52, 59 communicates with the fluid chamber compartment 38, whereas another passage 61 interconnects the other side of the valve 52, 59 and the chamber compartment 39.

In the fluid chamber 19 a bypass passage is formed by a peripheral groove 70 in the fluid chamber wall. This groove 70 extends symmetrically in both directions from and under the fulcrum pin 27. A leaf spring valve element 72 is mounted in a recess 73 in the fulcrum pin 27 (see FIG. 1.) and extends beyond the ends of the groove 70. The leaf spring 72 has a nominal, unloaded shape which makes it diverge from the fluid chamber wall and, accordingly, by its shape be pretensioned toward an open condition relative to the groove 70.

The leaf spring 72 comprises in fact two separate valves $72^1$ and $72^{11}$, one for each direction of operation of the tool. The two valves $72^1$, $72^{11}$ are separated by the fulcrum pin 27 which forms a retaining means for both of the valves $72^1$, $72^{11}$. One of the valves $72^1$ is located in fluid chamber compartment 38 whereas the other $72^{11}$ is located in compartment 39. Hook shaped abutments 75, 76 are mounted in the fluid chamber wall to define the open condition of the springs $72^1$, $72^{11}$.

The operation order of the impulse mechanism shown in FIGS. 1 to 7 is described below with particular reference to FIGS. 2 to 5. The inertia drive member 10 receives rotational power from the motor of the tool via splined shaft 24 and socket portion 23. The inertia member 10 is rotated in a clockwise direction as illustrated by arrows in FIGS. 2 to 5.

To begin with, let us assume that a torque resistance in the screw joint being tightened has already been built up and that the parts of the impulse mechanism occupy the very positions shown in FIG. 2. In this sequence of the operation, the piston 30 is just about to complete its return stroke in a direction from the fluid chamber compartment 38 to the opposite compartment 39. This is accomplished by the cooperation of the cam surface 42 on the output spindle 11 and the gradually sloping cam surface 44 on the piston 30.

During its return stroke, the piston 30 has changed the volumes of the two fluid chamber compartments 38, 39 such that the volume of compartment 38 is increased whereas compartment 39 has become smaller. In the very position shown in FIG. 2, the two compartments 38, 39 are still sealed off relative to each other, since the seal portion 31 of the piston 30 is in contact with pin 28.

During the limited portion of the piston return stroke when sealing contact between seal portion 31 and pin 28 exists, a certain pressure difference between the two compartments 38, 39 arises. Due to the fact, however, that the cam surface 44 on the piston 30 is just gradually sloping inwards and that it is located at a relatively big distance from the fulcrum 27 of the piston 30, the piston speed during the return stroke is relatively low. This means that the flow of fluid through passage 70 is rather slow and a rather small pressure drop only arises across valve $72^{11}$. This pressure drop is too small to make the valve $72^{11}$ shift from open condition to closed condition. Accordingly, fluid is free to pass through passage 70 from compartment 39 to compartment 38. As a result of the valve controlled bypass there is virtually no fluid flow resistance during the piston return stroke.

At continued rotation of the inertia drive member 10 and piston 30 relative to the output spindle 11, the abruptly inclined cam surface 43 on the piston 30 gets into contact with the cam surface 42 on the output spindle 11. This position, illustrated in FIG. 3, means the beginning of the impulse generating work stroke of the piston 30. Since the abruptly inclined cam surface 43 of the piston 30 meets the abruptly inclined cam surface 42 on the output spindle 11 and since the contact point of the cam surfaces is relatively close to the piston fulcrum 27 and the speed of the inertia member 10 has increased further, a very fast acceleration of piston 30 is accomplished.

Figure 4:
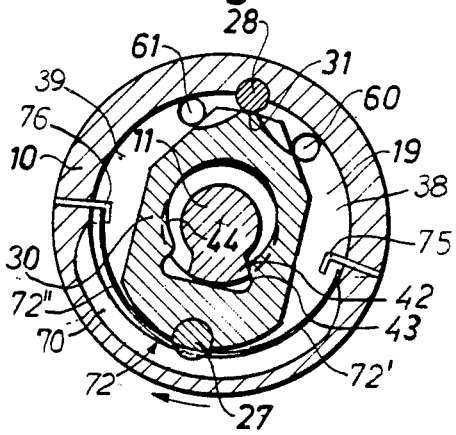
Figure 3:
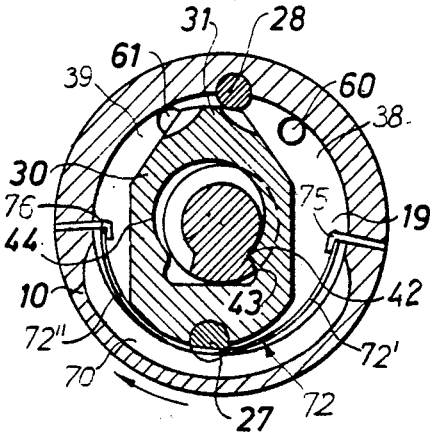
Figure 5:
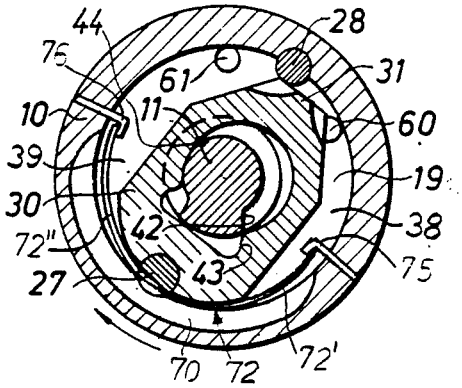
Figure 6:
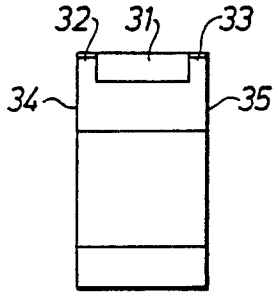
FIG. 6 shows a side view of the piston incorporated in the tool shown in FIGS. 1 to 5.

At the very start of the impulse stroke, communication is still maintained between the two fluid chamber compartments 38, 39, because the seal portion 31 has not yet reached the seal pin 28. See FIG. 3. After a very short time interval, however, the seal portion 31 has established a fluid seal between the compartments 38, 39 by cooperating with seal pin 28. This position is shown in FIG. 4. The fluid velocity past valve $72^1$ increases rapidly and the pressure drop across valve $72^1$ instantaneously reaches a level where the valve $72^1$ is automatically shifted from open condition to closed condition. See FIG. 4.

Due to the abruptly shaped cam surfaces 43 and 42 and their close location relative to the piston fulcrum 27, the kinetic energy of the rotating inertia drive member 10 is transformed into a pivoting movement of the piston 30 in a very efficient way. However, the back pressure in the right hand fluid chamber compartment 38 is very high and corresponds to the kinetic energy of the inertia drive member 10 which is transferred to the piston 30 via the fulcrum pin 27.

The big pressure difference now obtained between the two fluid chamber compartments 38, 39 brings the piston 30 abruptly to a stand still relative to the drive member 10. The result of this heavy, suddenly arisen hydraulic pressure acting on the piston 30 is that all the kinetic energy received from the inertia drive member 10 is transferred onto the output spindle 11 via the cam surfaces 43 and 42. A torque impulse is being delivered to the output spindle 11.

As the kinetic energy has been transferred to the output spindle 11 and the rotation speed of the inertia drive member 10 is brought down to stand still, the pressure difference across the piston 30 is substantially reduced. Due to the decreased pressure difference between the two fluid chamber compartments 38, 39 as well as across the leaf spring valve $72^1$, the latter returns immediately and automatically to its open position. This means that fluid communication is reestablished through passage 70 and that the piston 30 does not have to overcome any fluid flow resistance during its remaining movement under sealing engagement with pin 28. Having its abruptly inclined cam surface 43 still in contact with the cam surface 42 on the output spindle 11, the piston 30 is pivoted further to the right such that the sealing contact between seal portion 31 and seal pin 28 is definitely broken. See FIG. 5.

At continued rotation of the inertia drive member 10 relative to the output spindle 11, the edge of the piston cam surface 43 slips past the outer corner of the output spindle cam surface 42. See FIG. 5. From then on the piston 30 and the inertia drive member 10 are free to rotate for about half a revolution relative to the output spindle 11 without anything happening. When, however, such a 180 degree relative rotation is completed, the gradually sloping cam surface 44 of the piston 30 starts engaging the outer corner of the cam surface 42 on the output spindle 11. At continued relative rotation, another return stroke of the piston 30 is performed. As being described above, the return stroke is comparatively slow and does not give rise to any fluid flow that is large enough to make the leaf spring valve $72^{11}$ shift to closed condition.

At a predetermined pretension level in the screw joint the pressure peaks in the fluid chamber 19 reach a magnitude at which the valve ball 59 is lifted from the seat 52 against the action of the spring 58. Hydraulic fluid is then bypassed from the high pressure chamber compartment 38 to the low pressure compartment 39. Thereby, the output torque of the tool is limited.

Figure 8:
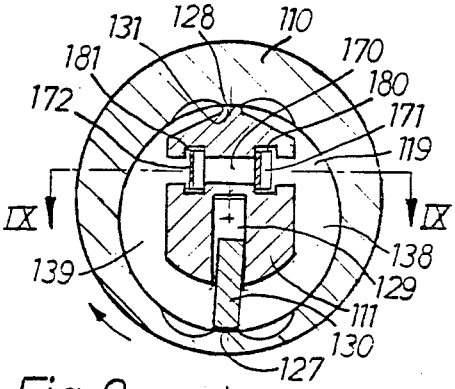
FIG. 8 shows a cross section through a vane type impulse tool comprising a bypass controlling valve according to the invention.
Figure 9:
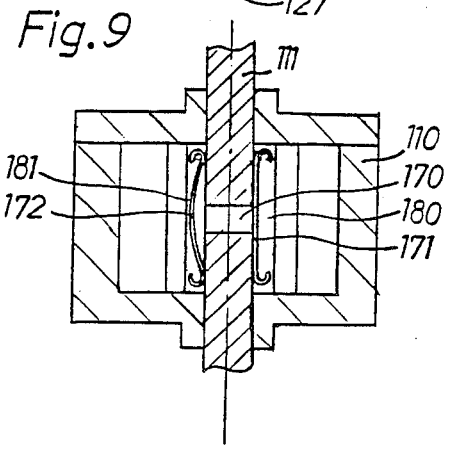
FIG. 9 shows a fragmental section along line IX—IX in FIG. 8.

In the vane type torque impulse mechanism shown in FIGS. 8 and 9, an inertia drive member 110 is rotated by a motor (not shown) and comprises a cylindrical fluid chamber 119 which encloses the rear end of the output spindle 111. A vane 130 is slidably supported in a slot 129 in the output spindle 111 and arranged to divide together with an oppositely located ridge 131 on the output spindle 111 the fluid chamber 119 into two compartments 138, 139. The latters are sealed off from each other during a short interval only of the relative rotation between the drive member 110 and the output spindle 111 when sealing contact is obtained with two opposite lands 127, 128 in the fluid chamber 119.

As in the above described torque impulse tool there is provided a bypass passage 170 through which the hydraulic fluid may pass from one of the fluid chamber compartments 138 to the other 139, or vice verse. The bypass passage 170 is controlled by two leaf spring valves 171, 172 which by their shape are pretensioned toward open condition. The bypass passage 170 as well as the leaf spring valves 171, 172 are located in the output spindle 111. The bypass passage 170 comprises a bore extending transversely through the output spindle 111 and two parallel axially extending T-shaped grooves 180, 181 in which the leaf spring valves 171, 172 are supported.

In FIGS. 8 and 9, the impulse mechanism is shown in an impulse delivering position where sealing engagement is established between the vane 130 and land 127 as well as between ridge 131 and land 128. A high pressure peak is built up in fluid chamber compartment 138, which means that a big pressure drop arises across leaf spring valve element 171 causing the latter to shift to closed condition. This position is illustrated in FIGS. 8 and 9.

As energy is transferred from the inertia drive member 110 to the output spindle 111, the drive member 110 is stopped instantaneously somewhere within the interval of relative rotation where the fluid chamber compartments 138, 139 are still sealed off from each other. This means that, firstly the high pressure difference between the compartments 138, 139 is discontinued, and secondly, as a result of that, the leaf spring valve 171 is reopened. Due to the reestablished bypass communication between the fluid chamber compartments 138, 139, there will be no hydraulic resistance to continued rotation of the drive member 110 as the latter is to be accelerated for the next impulse generating cycle. This means in turn that the next impulse cycle is started quicker and that the impulse rate of the tool is increased.

When operating the impulse mechanism in the opposite direction the other leaf spring valve 172 is effective in preventing bypass flow in the opposite direction during the high pressure sequence.

The invention is not limited to the shown and described examples but may be freely varied within the scope of the claims. For instance, the bypass passage and leaf spring valve means may be located at the piston in the first described type of impulse mechanism.

In a further embodiment of the invention the bypass passage and leaf spring valve means are located in the inertia drive member but outside the fluid chamber. Preferably, such a bypass passage is located in one of the end walls of the fluid chamber, and the leaf spring control valve may have the shape of a washer which is preformed by bending along a diameter line.

I claim:

1. A hydraulic torque impulse tool, comprising:

a tool end housing, an inertia drive member in said housing and coupled axially to a motor shaft at one end of said housing, said drive member having an interior fluid chamber, an output spindle extending from an opposite end of said housing and including an impulse receiving rear portion extending axially into said fluid chamber, impulse generating seal means arranged for relative pivotal movement in said fluid chamber and arranged to divide said fluid chamber into a high pressure compartment and a low pressure compartment during a limited portion of movement relative to said fluid chamber, said seal means engaging said impulse receiving rear portion of said output spindle for transmitting torque impulses to the output spindle, fluid passage means associated with said fluid chamber and extending past said seal means in the direction of rotation, for communicating fluid between said high pressure compartment and said low pressure compartment of said fluid chamber at certain times during rotation of said drive member, said fluid passage means comprising first opening means located in said high pressure compartment for allowing fluid to be conducted to said low pressure compartment, and second opening means located in said low pressure compartment for allowing fluid to enter said low pressure compartment, and a pressure responsive leaf spring valve at least a major part of which is located within said high pressure compartment and arranged to control said first opening means so that fluid flow through said first opening means and said fluid passage means is controlled in response to a difference in pressure between said high pressure compartment and said low pressure compartment, wherein when said difference in pressure exceeds a certain level, said leaf spring valve shifts from an open condition to a closed condition to prevent fluid flow through said fluid passage means so that substantially all kinetic energy received from said inertia drive member is transferred to said output spindle; and wherein said fluid chamber is cylindrical in shape, and said leaf spring valve is disposed substantially peripherally along the circumferential wall of said fluid chamber and is formed to assume a shape discontinuous with said wall when in said open condition.

2. Torque impulse tool according to claim 1, wherein said leaf spring valve by its shape is preloaded toward said open condition, and an abutment means is provided to define by positive engagement with said leaf spring valve said open condition of the latter.

3. Torque impulse tool according to claim 1, intended for operation in either of two opposite directions, wherein said leaf spring valve comprises a first leaf spring portion for controlling said first opening means and a second leaf spring portion for controlling said second opening means.

4. Torque impulse tool according to claim 1, in which said seal means comprises a piston element pivotably movable in a plane transverse to the rotation axis of said inertia drive member, and wherein said first opening means and said second opening means are located in the wall of said fluid chamber, said leaf spring valve being associated with said fluid chamber wall.

5. Torque impulse tool according to claim 3, wherein said first leaf spring portion and said second leaf spring portion are interconnected and forming a one piece element.

* * * * *